US007052528B2

(12) United States Patent
Babjak et al.

(10) Patent No.: US 7,052,528 B2
(45) Date of Patent: May 30, 2006

(54) METHOD FOR REMOVAL OF MN FROM COBALT SULFATE SOLUTIONS

(75) Inventors: Juraj Babjak, Ontario (CA); Miyuki Imai, Osaka (JP); Tomoaki Kikkawa, Osaka (JP)

(73) Assignee: Seido Chemical Industry Company, Ltd., Osaka (JP)

( * ) Notice: Subject to any disclaimer, the term of this patent is extended or adjusted under 35 U.S.C. 154(b) by 0 days.

(21) Appl. No.: 10/729,911

(22) Filed: Dec. 9, 2003

(65) Prior Publication Data

US 2005/0120828 A1 Jun. 9, 2005

(51) Int. Cl.
*C22B 47/00* (2006.01)

(52) U.S. Cl. ..... 75/739
(58) Field of Classification Search ..... 75/739, 75/585; 423/51
See application file for complete search history.

(56) References Cited

U.S. PATENT DOCUMENTS 2,822,243 A * 2/1958 Brix ..... 423/51

FOREIGN PATENT DOCUMENTS

| | | | |
|---|---|---|---|
| EP | 0 630 856 | * | 12/1994 |
| JP | 357140838 A | * | 8/1982 |
| JP | 2002-241856 | | 8/2002 |

* cited by examiner

*Primary Examiner*—Roy King
*Assistant Examiner*—Kathleen McNeils
(74) *Attorney, Agent, or Firm*—Wenderoth, Lind & Ponack, L.L.P.

(57) ABSTRACT

The present invention provides a method for the removal of substantially all the amount of Mn contained in cobalt containing solution thereby to obtain purified cobalt solution with Mn content of 10 ppm or less and specifically a method for removing Mn from cobalt sulfate solution comprising the steps of adjusting pH of the solution within the range of 3–6 and then adding the NaOCl to the solution to obtain an oxidation-reduction potential in the range of 1100 to 1300 mV, with respect to standard hydrogen electrode (SHE); and removing Mn precipitate from thus treated solution.

6 Claims, No Drawings

METHOD FOR REMOVAL OF MN FROM COBALT SULFATE SOLUTIONS

BACKGROUND OF THE INVENTION

1. Field of the Invention

The present invention relates to a method for the removal of Mn from cobalt sulfate solutions, and more particularly to a method for removing Mn from the cobalt containing solutions by oxidative precipitation and liquid/solid separation to obtain a purified cobalt containing solution with substantially depleted Mn content.

2. Description of the Prior Art

The demand for valuable metals such as cobalt has increased in many industrial fields. The value of cobalt is very high since highly purified cobalt is difficult to extract from raw materials such as ores. The major source of cobalt comes from lateritic or oxide ores which are accompanied by a variety of different elements such as Ni, Zn, Cu and Mn. Some elements contained in ores have similar chemical properties to cobalt, making their separation rather difficult. One of the impurities which is difficult to separate is Mn. To supply the industrially required purified cobalt, Mn must be removed in a cobalt purification process. One of the cobalt purification methods for removing Mn is dissolving the cobalt containing material in an acidic solution and then chemically treating cobalt and Mn in the solution.

For example, Fonseca et al discloses, in "Proceedings of the international symposium on Electrometallurgical Plant Practice, held at Montreal, Quebec, Canada, Oct. 21–24 in 1990", a method for the removal of low concentrations of cobalt and Mn from a zinc sulfate solution using sodium hypochlorite (NaOCl). The test results showed that over 99.9% Mn was removed and between 33–99.7% Co was removed from Zn sulfate solution. This process is not effective in an industrial scale process, since the removal of Mn would not be possible without co-precipitating substantial quantities of cobalt and it is difficult to separate Co from the co-precipitated mixture.

Zhang et al discloses, in "Hydrometallurgy vol. 63 pp 127–135 published in 2002", a method for oxidative precipitation of Mn with $SO_2$ and $O_2$ to separate it from Co and Ni. EP1159461 discloses a method for recovering of Ni and Co from lateritic ore leach liquor, which beside Ni and Co contains a number of impurities such as Mn, Mg and Ca. According to this method, Ni and Co are selectively recovered from this liquor by ion exchange using bis-2-picolyl amine resin, which is highly selective for Ni and Co over the impurity elements.

EP1305455 discloses an apparatus and a method for producing high purity metals such as Co. According to this method, Co is selectively extracted from $CoCl_2$ and/or $CoSO_4$ solution by a combination of electrolysis and ion exchange.

JP2002-241856 discloses a method for recovering valuable metal from used nickel-hydrogen secondary battery by oxidative precipitation. According to that method, valuable metals such as Ni and Co can be recovered from a sulfuric acid solution containing valuable metals by removing Mn using nickelic and/or cobaltic hydroxide as an oxidizing agent.

It is difficult to selectively separate Mn from the co-precipitated material.

So far, none of the known cobalt purification method can remove Mn essentially completely (below 10 ppm level) from cobalt containing solution without co-precipitating substantial quantities of cobalt.

Thus purified cobalt obtained by purifying the cobalt containing solution contains more than 10 ppm of Mn. Therefore, it is desired to develop a method for separating Mn from cobalt containing solution, which enables to obtain cobalt with Mn content of 10 ppm or less.

SUMMARY OF THE INVENTION

Accordingly, the present inventors have been intensively studied to improve the above-described drawbacks. In accordance with the present invention, there is provided a method for the removal of Mn from cobalt sulfate solutions.

The present invention provides a method for removing Mn from cobalt sulfate solution comprising the steps of: adjusting pH of the solution within the range of 2.5 to 6; adding the NaOCl to the solution to obtain an oxidation-reduction potential in the range of 1100 to 1300 mV, with respect to standard hydrogen electrode (SHE); and removing Mn precipitate from thus treated solution.

DETAILED DESCRIPTION OF THE PREFERRED EMBODIMENTS OF THE INVENTION

As described below in detail, the present invention provides a method for removing Mn from cobalt containing solution. Specifically, the object of the present invention is to provide a method for the removal of substantially all the amount of Mn contained in cobalt containing solution thereby to obtain purified cobalt solution with Mn content of 10 ppm or less.

Another object of the present invention is to provide a method for the removal of Mn from the solution without removing a substantial amount of cobalt with Mn.

Further object of the present invention is to provide a simple and reliable means of controlling the process. The invention is explained with reference to an exemplary method for removing Mn from cobalt sulfate solution, but it is to be understood that the method of the invention can also be modified as long as the effect of the invention can be attained.

A cobalt sulfate solution containing at least cobalt and Mn (hereinafter may be called as "starting solution") is supplied to a reactor equipped with an oxidation-reduction potential (ORP) measuring and/or controlling unit. The solution is subjected to an oxidative precipitation treatment within the predetermined oxidation-reduction potential as mentioned below to oxidize Mn ions to a higher valency oxides ($Mn_2O_3$ and/or $MnO_2$) without oxidizing cobalt ion. Mn oxides are preferably precipitated during the oxidative treatment. After the oxidative treatment, the suspension is subjected to a liquid/solid separation by which Mn precipitate is separated from the solution as a solid (residue) and cobalt is contained in a filtrated solution (filtrate). Thus obtained solution contains cobalt with Mn content of 10 ppm or less. The solution then may be subjected to any additional treatment steps to obtain the purified cobalt in the desired form.

The present invention can be carried out in either batch process or continuous process. When conducting the continuous process, preferably two or more reactors in series are used and the resulting suspension, exiting the last reactor is then passed to the solid/liquid separation in succession.

According to the invention, any cobalt sulfate solution can be used as long as it contains cobalt and Mn. For example, cobalt contained in the following materials can be used in the present invention:

Cobalt from primary (naturally occurring) sources;

Lateritic ores in which Ni/Co ratio is usually 10/1.

The primary objective to treat such ores is the Ni recovery. Co is more less by-product of such activity. Sulfide ores in which Ni/Co ratio is usually 100/1. In this case also Co is by-product of Ni recovery Sea nodules (on the bottom of some regions of Pacific ocean). The objective would be Ni and Co recovery and perhaps also Mn.

Some Cu ores, particularly those found in Democratic republic of Congo and Zambia, are fairly rich in Co. Hydrometallurgical treatment of first three sources results in relatively dilute Ni-Co solutions, containing many impurity elements. In this case, the preferable next step to be taken is separation and concentration of Ni and Co, often accomplished by solvent extraction and ion exchange using Ni and Co selective reagents. For example Ni and Co could be selectively co-extracted (some impurity elements are co-extracted to some degree) into the organic phase or ion exchange resin and then stripped with e.g. sulfuric acid to produce purer and more concentrated solution. More often Co would be extracted selectively first (plus small amount of impurities) and concentrated by producing a strip liquor.

Then the present invention can be applied to remove Mn from such solutions or from solutions refined in one or few more steps.

Cu ores mentioned above would be first leached in $CuSO_4$—$H_2SO_4$ spent electrolyte. Cu would then be recovered by electrolysis and a portion of spent electrolyte would be further purified, concentrated to produce a concentrated $CoSO_4$ solution, containing small amounts of impurities (Mn involving). Then the present invention is applied to remove Mn from such solutions.

In addition to the above mentioned cases, cobalt is contained in various scrap or recycled materials, e.g. used (scrap or recycled) Ni-Metal Hydride batteries (NiMH), used Li-ion batteries or other Co-containing batteries. Highly magnetic alloys or certain electronic scrap materials are other examples.

Leaching these materials followed by some sort of pre-purification/concentration would generate fairly concentrated $CoSO_4$ solution containing small amount of impurities. Such solutions can also be treated by the present invention.

Therefore, cobalt sulfate solution derived from various materials that contains cobalt and Mn can be used in the invention. For example, Cobalt sulfate solution can be prepared from the ore by leaching either oxide or sulfide ores with sulfuric acid. The ore may be any laterite (oxide) or sulfide ore and the laterite ore may include the saprolite and limonite. It should be noted that the effect of the present invention can be fully attained only when using cobalt sulfate solution. Therefore, cobalt solutions prepared by any other acids (except sulfuric acid), such as hydrochloric acid or nitric acid, are not too suitable feedstock for the treatment by the process of this invention.

As mentioned above, the cobalt sulfate solution prepared by any known method can be used in the present invention as long as it contains cobalt and Mn. The present invention can be conducted even if the solution contains other impurities such Ni, Zn, La, Nd, Al, Mg, Cu, Ca, Pb, Cd and the like which may be contained in the starting materials. The starting solution may be pre-treated before treating by the present invention by known processes to remove impurities or to eliminate solid materials contained in the solution if any. For example, the solution can be pre-treated by known methods, such as e.g. ion exchange, solvent extraction and precipitation, to remove certain impurities before conducting the oxidative precipitation of Mn.

According to the present invention, in spite of the amount of cobalt, Mn and other impurities in the starting solution, Mn can be removed by the present inventive method. Concentration of cobalt in the solution is not specifically restricted beyond the solubility limit of cobalt sulfate. The higher concentrations would increase the solution viscosity and also create the possibility of $COSO_4$ crystallization. Therefore, the concentration of cobalt is preferably 120 g/L or lower.

If the concentration of cobalt is too low, the process efficiency is decreased. The concentration of cobalt is preferably 5 g/L or more, more preferably 50 g/L or more, and most preferably around about 100 g/L (±10 g/L).

Concentration of Mn in the solution is not specifically limited but if the concentration of Mn is too high, the degree of Co co-precipitation may increase proportionally. The concentration of Mn is preferably 5 g/L or less, more preferably 1 g/L or less, and most preferably 0.1 g/L or less.

Concentration of impurities other than Mn such as mentioned above in the solution is not specifically limited.

The pH of the starting solution is preferably adjusted to about more than 2.5 to 6 or less, more preferably 3.5 to 5.5, and most preferably 4 to 5 before the addition of an oxidative agent. If the pH of the starting solution is within this range, Mn is effectively precipitated immediately after the oxidation potential reached the specific value. Since if the pH of the starting solution is adjusted as mentioned above, the pH of the solution is decreased by the addition of the oxidative agent to 1.5 to 2.5 which is preferable range to conducting the Mn precipitation.

The pH adjusted starting solution is introduced into the reactor equipped with an ORP measuring/controlling set-up, allowing to adjust and maintain the redox potential within the predetermined values.

According to the present invention, the oxidative agent is added after introducing the solution to the reactor. According to the invention, sodium hypochlorite (NaOCl) should be preferably used as the oxidative agent. Since it is a simple, inexpensive, readily available, and environmentally acceptable reagent and most effective to conduct the oxidative precipitation of Mn from the solution. The use of, for example, $SO_2$ plus air or oxygen and of ozone and the use of persulfate or Caro's acid, which are too expensive and needs much more complex process. Therefore, the use of such as persulfate will lower the effectiveness of the oxidative precipitation.

NaOCl oxidizes Mn(II) ions in the solution to Mn(III) and/or Mn(IV), forming the precipitate which is easily removed by the present invention.

The amount of the oxidative agent in the solution is not specifically limited as long as oxidation-reduction potential (hereinafter may be called "ORP") during the process is maintained within the predetermined range mentioned below. If the amount of oxidative agent is too small, the amount of oxidized Mn may be decreased and thus Mn impurity level in the cobalt solution obtained by solid/liquid separation is increased. On the other hand, if the amount of oxidative agent is too large, cobalt may be oxidized with Mn thus a significant amount of cobalt is removed by solid/liquid separation with Mn.

By adjusting the amount of the oxidative agent in the solution to obtain the above ORP value, almost all the amount of Mn contained in the solution can be oxidized by the oxidation-reduction reaction and the generated Mn precipitate removed by solid/liquid separation. Thus the amount of Mn contained in the filtrate can be almost zero (10 ppm or less) and co-precipitation of cobalt with Mn is suppressed.

As the oxidative agent, commercially available NaOCl solution can be used by diluting it with water if necessary.

The addition of the oxidative agent decreases the pH of the solution. According to the present invention, if the pH of the solution is too high, it is difficult to increase the redox-potential to the desired level. Therefore, the pH of the solution during the precipitation is preferably maintained to 1.5 to 2.5. If the pH of the solution becomes too acidic, it might be necessary to add the base into the reaction mixture to bring the pH to this range. Otherwise at a too low pH the precipitation of Mn would not be completed. The precipitation reaction involves the release of hydrogen ions, so that the pH decreases during Mn precipitation. The pH adjustment during the precipitation may be required in order to achieve the desired degree of Mn removal. At pH values above 2.5, the precipitation of $Co(OH)_2$ is encountered.

When conducting the oxidative precipitation, the ORP is adjusted to preferably 1100 mV or higher, more preferably 1150 mV or higher, and most preferably 1200 mV or higher with respect to a standard hydrogen electrode (SHE). If ORP is below 1100 mV, the oxidation of Mn is not completed and thus it is difficult to obtain purified cobalt solution with Mn content of 10 ppm or less by solid/liquid separation. On the other hand, if ORP is above 1300 mV, the degree of Co co-precipitation becomes higher. Therefore, ORP is adjusted to preferably 1300 mV or lower, more preferably 1250 mV or lower with respect to SHE.

A reaction temperature of the solution during the oxidative precipitation is not specifically limited to the specific range as long as the reaction can be conducted. According to the present invention, efficiency of Mn oxidation rate is improved at a higher reaction temperature of the solution. Therefore, the preferable temperature of the solution is 25° C. or above, and most preferably 50° C. or above. On the other hand, if the temperature of the solution becomes too high, the solution can reach the boiling point and the crystallization of $CoSO_4$ could occur. Therefore, the temperature of the solution is preferably 100° C. or below, and most preferably 60° C. or below.

The oxidized Mn is precipitated during the oxidative reaction. It is preferable to enlarge the size of the Mn precipitate by aggregating it to improve separation rate when the suspension is processed by solid/liquid separation. If the oxidative agent is added to the solution, too rapidly the Mn precipitate size may not be large enough to achieve the desired degree of separation. Thus obtained solution after solid/liquid separation may contain more than 10 ppm of Mn and also filtration time may take long time. Therefore separation efficiency could not be improved if the feeding speed of the oxidative agent to the solution is too fast. On the other, if a feeding speed of the oxidative agent to the solution is too slow, the process becomes less efficient, thus requiring larger reactor(s).

If the oxidative agent is added to the solution preferably within the range of 10 to 40 min, the size of aggregated Mn precipitate becomes large enough to improve the separation rate and efficiency. Thus obtained filtrate may contain 10 ppm or less of Mn and also filtration time can be shortened. To improve this effect, it is preferable to add oxidative agent at the rate between 0.001 and 0.005 L/[(L of reactor volume) *minute] and most preferably at 0.0015 [L/(L*min)] or simply at 0.0015[L/L*min].

After Mn is oxidized, the obtained suspension is subjected to a solid/liquid separation. As the solid/liquid separation method, any known method such as filtration or centrifuging can be utilized in the present invention. According to the present invention, filtration is preferably used. Any conventionally used filter material can be used for filtering the suspension. Herein, the present invention is described by filtration as solid/liquid separation method.

By the filtration, Mn is removed from the solution as a solid precipitate. That is, Mn is collected as a filter cake and thus almost all amount of Mn contained in the starting solution is removed by the filtration and the filtrate contains substantially all amount of cobalt contained in the starting solution and less than 10 ppm of Mn. By the present invention mentioned above, oxidation of cobalt is suppressed during the oxidation process and thus the amount of cobalt removed by the filtration with Mn is very small, generally below 1%.

The following examples illustrate, but do not limit, the present invention.

EXAMPLES

Tests were conducted in a 2L operating volume reactor, equipped with 4 baffles, an axial, downward pumping impeller, a redox electrode, a pH electrode and temperature controller.

Cobalt sulfate solution containing 100 g/L of cobalt and 50 mg/L of Mn having pH of 5 was prepared by dissolving appropriate quantities of the respective carbonates in sulfuric acid.

The reactor was filled with approximately 2L of the cobalt sulfate solution, and the reactor content heated to the operating temperature of 50° C. Then a quantity of a dilute NaOCl aqueous solution (around 10 g/L of NaOCl) was added into the reactor as shown in Table 1. The OPR (mV) of the cobalt sulfate solution was changed as shown in Table 1.

After the ORP adjustment to predetermined level, the resulting suspension was then vacuum filtered using Buchner funnel and a purified solution thus obtained was analyzed for Mn content. In some instances the filter cakes of Nos. 3–5 were dissolved in an acid and the resulting solution then analyzed for cobalt and Mn content in order to determine the degree of cobalt co-precipitation. The tests were conducted without adjusting pH of the reacting mixture. Therefore, the pH of reacting solution was allowed to decrease naturally and the value of pH, shown in Table 1 is the measured value at the end of the oxidation process.

TABLE 1

| Test No. | NaOCl (ml) | ORP (mV) | pH | Mn content in Filtrate (mg/L) | Co co-precipitation (% of Feed) |
|---|---|---|---|---|---|
| 1 | 40 | 1090 | 3 | 23.5 | Not tested |
| 2 | 60 | 1140 | 2.3 | 9.3 | Not tested |
| 3 | 80 | 1200 | 2.1 | 1.3 | 0.6 |
| 4 | 100 | 1260 | 1.85 | 0.4 | 0.7 |
| 5 | 150 | 1315 | 1.6 | 0.2 | 1.1 |

It can be seen from the above results that the degree of Mn removal is affected by the OPR.

Example 2

Tests were performed using 100 mL of diluted NaOCl solution (10 g/L of NaOCl), which was added at different speeds (NaOCl rate) to determine its effect on the precipitated Mn oxides particle size, filtration rate, and the degree of Mn removal. Immediately after all the amount of the NaOCl solution was added, the suspension in the reactor was removed and filtered using same filter as used in example 1 under vacuum. After filtration, the particle size of the filter cake was measured by using Microtrac size analyzer (Microtrac is very well known name and manufacturer of the equipment). The results are shown in Table 2.

TABLE 2

| Test No. | NaOCl rate (min) | Filtration Time (s) | Microtrac D (50) (μm) | Mn Content in Filtrate (mg/L) |
|---|---|---|---|---|
| 6 | 5 | 127 | 0.57 | 0.47 |
| 7 | 10 | 113 | 0.59 | 0.14 |
| 8 | 20 | 100 | 0.76 | 0.16 |
| 9 | 30 | 99 | 0.89 | 0.30 |
| 10 | 40 | 94 | 0.98 | 0.20 |

It can be seen from the above results that Mn precipitation is quite rapid, making it suitable for either bath or continuous process application. The precipitate size increases with slowing the oxidative agent feeding speed.

According to the present invention, Mn is removed in a selective way from the starting solution by oxidative precipitation without co-precipitating cobalt. Therefore, Mn essentially free cobalt solution can be obtained by solid/liquid separation.

What is claimed is:

1. A method for removing Mn from a cobalt sulfate solution comprising the steps of:

adjusting a pH of the solution within the range of within the range of above 2.5 to 6;

adding sodium hypochlorite (NaOCl) as an oxidative agent to the solution to attain an oxidation-reduction potential in the range of 1100 to 1300 mV with respect to a standard hydrogen electrode (SHE), thus forming a precipitate of Mn; and removing the precipitated Mn from the solution.

2. The method of claim 1 wherein the precipitated Mn is removed by a solid/liquid separation.

3. The method of claim 2 wherein the solid/liquid separation is a filtration.

4. The method of claim 1 wherein the temperature of the cobalt sulfate solution during the addition of the oxidative agent is from 20° C. to 100° C.

5. The method of claim 1 wherein the oxidative agent is added at a rate of 0.001 to 0.005 liter of the NaOCl solution with a concentration of 1 wt. % per minute per liter of the cobalt sulfate solution.

6. The method of claim 1 wherein the pH of the solution is maintained within the range of 1.5 to 2.5 during the addition of the oxidative agent.

* * * * *